US008043051B2

(12) United States Patent
Brunner

(10) Patent No.: US 8,043,051 B2
(45) Date of Patent: Oct. 25, 2011

(54) SYSTEM, METHOD, AND APPARATUS FOR STACKABLE MULTI-STAGE DIFFUSER WITH ANTI-ROTATION LUGS

(75) Inventor: Christopher Marvin Brunner, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 1041 days.

(21) Appl. No.: 11/805,541

(22) Filed: May 23, 2007

(65) Prior Publication Data

US 2008/0292454 A1 Nov. 27, 2008

(51) Int. Cl.
*F01D 11/00* (2006.01)

(52) U.S. Cl. ..... 415/170.1; 415/901

(58) Field of Classification Search ..... 415/66, 415/170.1, 173.3, 174.2, 198.1, 199.1, 199.2, 415/199.3, 199.4, 199.5, 199.6, 213.1, 214.1, 415/901; 417/423.14, 423.3, 423.5, 423.11, 417/424.1, 424.2
See application file for complete search history.

(56) References Cited

U.S. PATENT DOCUMENTS

| | | | | |
|---|---|---|---|---|
| 2,376,528 | A | 5/1945 | Wislicenus | |
| 3,070,026 | A | 12/1962 | Lung | |
| 3,288,074 | A * | 11/1966 | Hall | 415/199.3 |
| 4,087,200 | A | 5/1978 | Korenblit et al. | |
| 4,098,558 | A * | 7/1978 | Bush et al. | 415/199.1 |
| 4,579,509 | A | 4/1986 | Jacobi | |
| 4,872,808 | A * | 10/1989 | Wilson | 415/170.1 |
| 5,839,205 | A * | 11/1998 | Hung | 34/97 |
| 6,318,964 | B1 | 11/2001 | Yang | |
| 6,439,835 | B1 * | 8/2002 | Chien et al. | 415/104 |
| 6,568,904 | B1 | 5/2003 | Ueyama et al. | |
| 6,726,449 | B2 * | 4/2004 | James et al. | 415/199.2 |
| 6,854,517 | B2 | 2/2005 | Gay et al. | |

* cited by examiner

*Primary Examiner* — Edward Look
*Assistant Examiner* — Ryan H Ellis
(74) *Attorney, Agent, or Firm* — Bracewell & Giuliani LLP

(57) ABSTRACT

A stackable multi-stage diffuser with anti-rotation lugs utilizes cast lugs and complementary recesses in the diffuser walls. When stacked in a housing, the lugs of lower diffusers nest inside the recesses of upper diffusers. The diffuser sections interlock and are mechanically locked in the housing to prevent rotation of the diffusers. Each diffuser is sealed directly to adjacent diffusers with o-rings, but do not contact or seal to the housing.

14 Claims, 3 Drawing Sheets

SYSTEM, METHOD, AND APPARATUS FOR STACKABLE MULTI-STAGE DIFFUSER WITH ANTI-ROTATION LUGS

BACKGROUND OF THE INVENTION

1. Technical Field

The present invention relates in general to downhole electrical submersible pumps (ESP) and, in particular, to an improved system, method, and apparatus for a stackable multi-stage diffuser with anti-rotation lugs for an ESP.

2. Description of the Related Art

Multi-stage diffuser pumps are typically assembled in a stack of diffuser components that are nested together. The diffuser stack slides inside a housing along an axis of the housing. The diffuser stack is subjected to compression by a bearing that is threaded into the housing until it makes contact with the top of the diffuser stack. The bearing is tightened to a calculated length, thus compressing the stack. This design prevents the diffusers from spinning inside the housing during operation due to the impellers that rotate inside them. The stack typically has grooves with O-rings that are located on the outer diameters (OD) of the diffusers to seal directly against the inner diameter (ID) of the housing itself. The O-rings are axially spaced apart in approximately one-foot increments throughout the axial length of the stack to contain any leakage between the diffuser faces and the housing. Although the O-rings are closely spaced apart, they are not used at every stage since the assembly and/or disassembly from the housing would become very difficult. In addition, the O-rings on the OD of the diffusers must slide across the internal threads of the housing when installing the stack into the housing, which can potentially cut and damage the O-rings. Thus, an improved diffuser stack design that overcomes these limitations would be desirable.

SUMMARY OF THE INVENTION

One embodiment of a system, method, and apparatus for a stackable multi-stage diffuser with anti-rotation lugs for an ESP is disclosed. Each stage of the diffuser assembly is provided with one or more "cast-in" lugs and complementary recesses in the diffuser walls. The lug features may comprise cast elements that do not require additional milling operations. The machine turning operations required for other portions of the design are virtually identical to those of other designs and thus add negligible cost to the part.

When stacked in assembly order, the lugs of one diffuser nest inside the recesses of an adjacent diffuser. The diffuser sections are thus interlocked with each other and mechanically locked in place to prevent rotation relative to the housing and each other as the impellers rotate inside the diffusers. The diffuser stack rests on the base of the assembly and the stages are nested and sealed to each other as described herein.

In one embodiment, each stage of the stack has an o-ring to provide sealing between the stages without burdening assembly, and there is only one direct seal between the stack and the housing. This design is simpler than conventional designs since the entire stack will easily slide into the housing without interference. Also, by utilizing an o-ring between every stage, the head performance per stage may be increased without losses due to leakage.

Since there is no compression required in this stack due to the cast-in lugs for anti-rotation, the stack is held in place by other simpler devices, such as a retaining ring on the ID of the housing. Replacement of the conventional threaded top compression bearing allows for more stages per housing to be assembled, thus increasing value.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
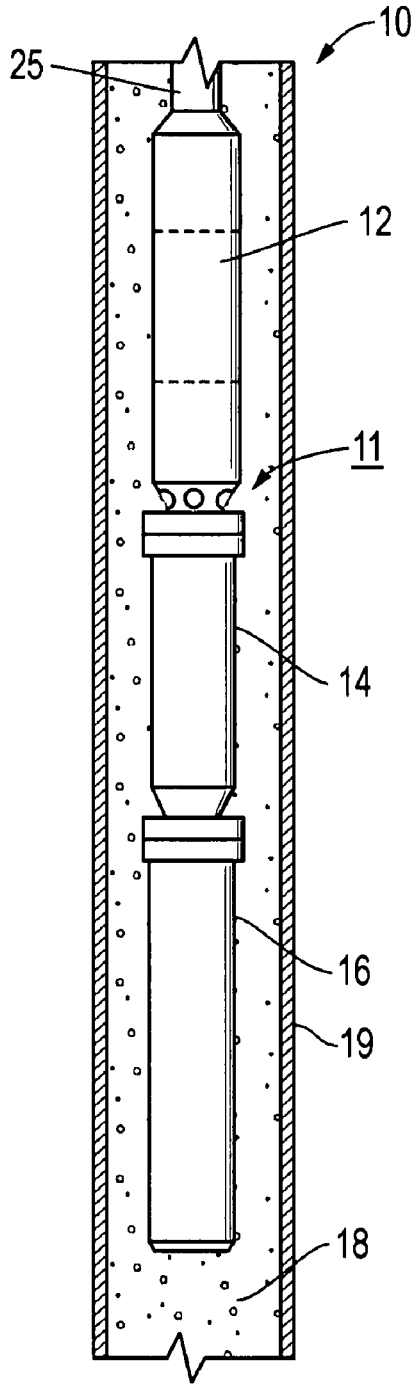
FIG. 1 is a perspective view of a centrifugal pump disposed in a fluid in a well, constructed in accordance with the invention.

Referring to the drawings, FIG. 1 generally depicts a well 10 with an electrical submersible pump (ESP) assembly 11 installed within. The pump assembly 11 comprises a centrifugal pump 12 that has a seal section 14 attached to it and an electric motor 16 submerged in a well fluid 18. The motor 16 has a shaft (not shown) that connects to the seal section shaft and is connected to the centrifugal pump 12. The pump assembly 11 and well fluid 18 are located within a casing 19, which is part of the well 10. Pump 12 connects to tubing 25 that conveys the well fluid 18 to a storage tank (not shown).

Figure 2:
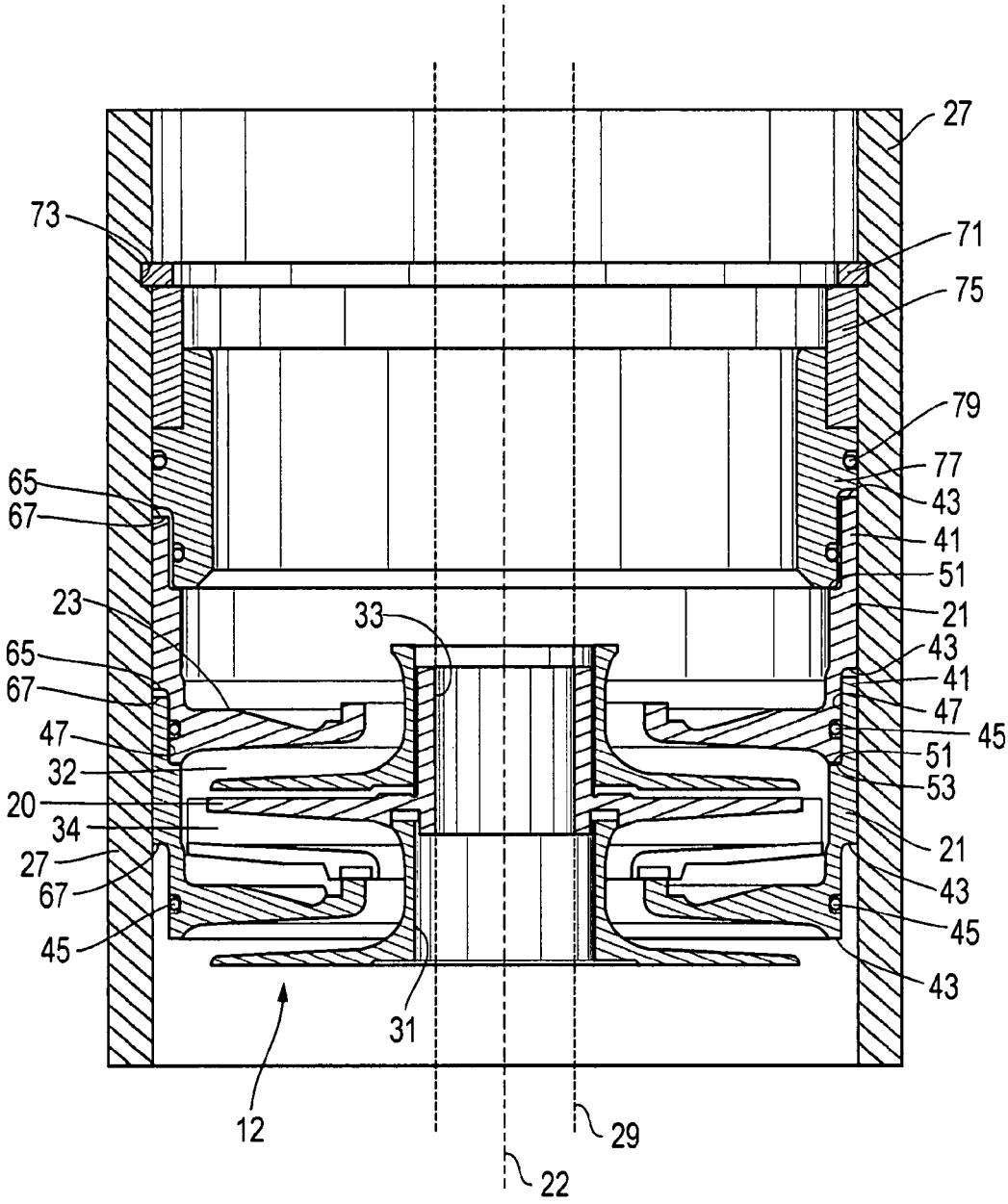
FIG. 2 is a sectional side view of one embodiment of a diffuser stack of the pump of FIG. 1 and is constructed in accordance with the invention.
Figure 3:
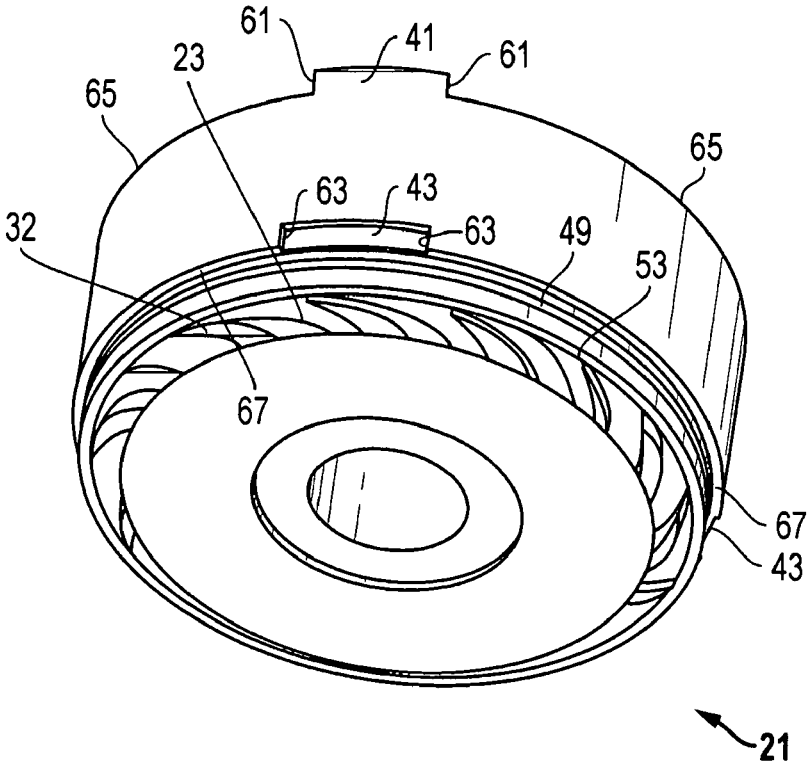
FIG. 3 is a lower isometric view of one embodiment of a single diffuser of the diffuser stack of FIG. 2 and is constructed in accordance with the invention.

Referring to FIG. 2, the centrifugal pump 12 has an axis 22 and a tubular housing 27 that protects many of the components of pump 12. Pump 12 contains a shaft 29 (shown in phantom) that extends axially through the pump. One or more diffusers 21 (e.g., two shown, and hundreds may be used) are co-axially positioned within housing 27 and have an inner portion with a bore 31 through which shaft 29 extends. Each diffuser 21 contains a plurality of passages 32 that extend through the diffuser 21. Each passage 32 is defined by vanes 23 (FIG. 3) that extend helically outward from a central area. Diffuser 21 is a radial flow type, with passages 32 extending in a substantially radial plane. The invention also is applicable to mixed flow types of diffusers.

An impeller 20 (only one shown) is typically located within each diffuser 21 to form a "stage" or sub-assembly. Impeller 20 also includes a bore 33 that extends the length of impeller 20 for rotation relative to diffuser 21 and is engaged with shaft 29. Impeller 20 also contains passages 34 that correspond to the openings in the diffuser 21. Washers (not shown) are placed between the upper and lower portions between the impeller 20 and diffuser 21.

Impellers 20 rotate with shaft 29 to increase the velocity of the fluid 18 (FIG. 1) being pumped as the fluid is discharged radially outward through passages 34. The fluid flows inward through passages 32 of diffuser 21 and returns to the intake of the next stage impeller 20, which increases the pressure of fluid 18 flowing therethrough. Increasing the number of stages by adding more impellers 20 and diffusers 21 can increase the pressure of the fluid.

Figure 4:
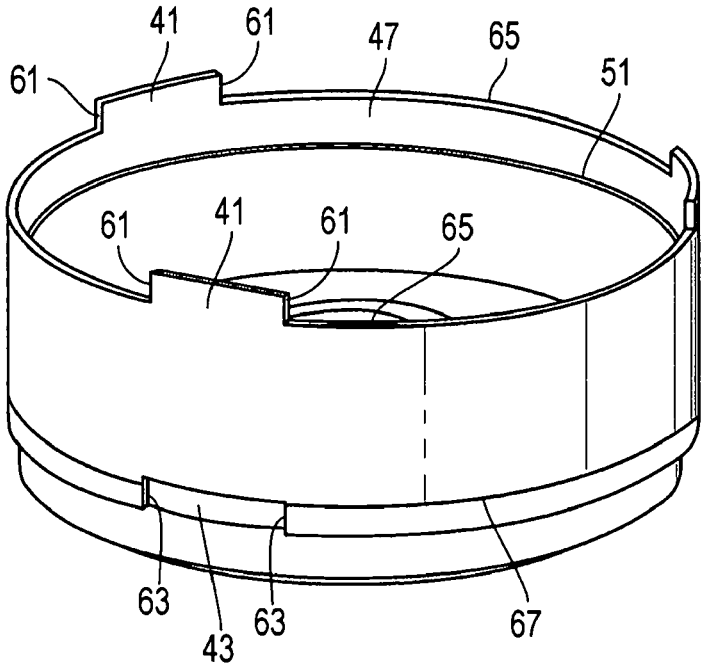
FIG. 4 is an upper isometric view of the diffuser of FIG. 3 and is constructed in accordance with the invention.

Referring again to FIGS. 2-4, one embodiment of diffuser assembly comprises the housing 27 having one or more of the diffusers 21 coaxially mounted therein. The stack of diffusers 21 rests on the bottom of the assembly in a conventional manner. As will be described herein, the diffusers 21 are mounted within the housing 27 to prevent relative rotation therebetween. In one embodiment, a radial clearance in a range of 0.003 to 0.005 inches separates outer diameters of the diffusers 21 and an inner diameter of the housing 27. Thus, the individual stages in the stack do not make contact with or seal to the housing 27.

Each diffuser 21 comprises a cylindrical body having at least one lug 41 (e.g., three) extending therefrom in an axial direction. A complementary recess 43 is formed in the cylindrical body extending in the axial direction opposite the lug 41. In the embodiment shown, the lugs 41 and recesses 43 are generally rectangular in profile, but arcuate in shape to match the curvature of the cylindrical diffuser 21. The lugs 41 and recesses 43 may be symmetrically arrayed castellations that engage and nest in equal numbers as shown.

The complementary recesses 43 receive and nest respective lugs 41 on axially adjacent diffusers 21 to form an interlocked stack that prevents relative rotation between the diffusers 21 and the housing 27. However, in one embodiment, the recesses 43 and lugs 41 do not make axial contact with each other (see small axial gaps therebetween illustrated in FIG. 2), but only prevent rotation via contact between lateral shoulders 61, 63 (compare FIGS. 3 and 4) on lugs 41 and in recesses 43, respectively. In addition, the radial outermost shoulders 65, 67 also do not make axial contact with each other as shown by the small axial gaps therebetween in FIG. 2.

In addition, a sealing member, such as an o-ring 45 (FIG. 2), is located on an exterior surface of each diffuser 21. In the embodiment shown, O-rings 45 seat in a circumferential recess 49 (FIG. 3) located below (i.e., axially spaced apart from) and radially inward of the recesses 43. The O-rings 45 seal against a radially recessed inner surface 47 (best shown in FIG. 4) formed on axially adjacent diffusers 21. Each diffuser 21 also has a pair of axially opposed upper and lower shoulders 51, 53 upon which the assembled diffusers make axial contact and seat. In the embodiment shown, shoulder 51 is formed adjacent the radially recessed inner surface 47 axially opposite lugs 41, while shoulder 53 is located on an exterior of diffuser 21, both axially and radially positioned between vanes 23 and recess 49.

In one embodiment, an upper end of the stack of diffusers 21 are mechanically locked to the housing with a retaining ring 71 that is mounted in an inner circumferential recess 73 formed in the housing 27. A retaining tube 75 is mounted to and extends from the retaining ring 71 and is coupled to the diffusers 21 with, e.g., a housing adapter 77 that mechanically engages an adjacent one of the diffusers 21, such that the housing adapter 77 vertically supports the stack in the housing 27. In the embodiment shown, the retaining ring 71 and the retaining tube 75 are located above the stack. The housing adapter 77 is sealed to the adjacent diffuser with an o-ring 45 (described above) that seals against surface 47. The housing adapter 77 also has a housing seal member 79 for sealing with the housing 27. In one alternate embodiment, a groove may be milled on the ODs of the diffusers to accept complementary keystock in order to hold the stages together.

In certain applications such as steam assisted gravity drain (SAGD), the heat of the well may cause the housing to stretch which would cause previous designs to lose compression. This loss of compression for stages is such that the rate of thermal expansion for the stage material is different than that of the housing which, through thermal cycling, eventually causes the stages to compression set. Any subsequent thermal cycling where the stage expansion cannot keep up with the housing expansion will lose compression on the stage stack. However, with the invention, any housing stretch is compensated for and the lugs still maintain their locked position between stages. Also, with the previously required compression bearing eliminated from the invention, the housing is not subjected to any undue stress from the torquing of the bearing.

While the invention has been shown or described in only some of its forms, it should be apparent to those skilled in the art that it is not so limited, but is susceptible to various changes without departing from the scope of the invention.

What is claimed is:

1. An electrical submersible pump assembly, comprising:

a motor coupled to a seal section, which in turn is coupled to a pump, wherein the pump comprises:

a housing having an axis;

a plurality of diffusers mounted in the housing, each diffuser comprising a cylindrical body having at least one lug extending therefrom in an axial direction, a complementary recess formed in the cylindrical body extending in the axial direction opposite the lug, the complementary recess receiving and nesting a respective lug on an axially adjacent diffuser to form an interlocked stack that prevents relative rotation between the diffusers;

a sealing member located on an exterior of each diffuser, and a surface formed on each diffuser that forms a seal with the sealing member on the axially adjacent diffuser; and a housing adapter mounted and sealed to at least one diffusers, the housing adapter having a housing seal member that seals with the housing.

2. A pump assembly according to claim 1, wherein the diffusers are mechanically locked to the housing to prevent rotation therebetween.

3. A pump assembly according to claim 2, wherein the interlocked stack is mechanically locked to the housing with a retaining ring mounted in a recess formed in the housing, and a retaining tube extends from the retaining ring and is coupled to the at least one diffuser.

4. A pump assembly according to claim 3, wherein the retaining ring and the retaining tube are located above the interlocked stack.

5. A pump assembly according to claim 1, wherein the at least one lug comprises a plurality of symmetrically arrayed castellations that are adapted to engage and nest in an equal number of complementary recesses on the axially adjacent diffuser.

6. A pump assembly according to claim 1, wherein the housing adapter vertically supports the interlocked stack in the housing and prevents rotation therebetween.

7. A pump assembly according to claim 1, wherein a radial clearance of 0.003 to 0.005 inches separates an outer diameter of the at least one diffuser and an inner diameter of the housing such that the diffusers are free of contact with and are unsealed to the housing.

8. An electrical submersible pump assembly, comprising:

a motor coupled to a seal section, which in turn is coupled to a pump, wherein the pump comprises:

a tubular housing having an axis;

a plurality of diffusers coaxially mounted in the tubular housing to prevent relative rotation therebetween, each diffuser comprising a cylindrical body having at least one lug extending therefrom in an axial direction, a complementary recess formed in the cylindrical body extending in the axial direction opposite the lug, the complementary recess receiving and nesting a respective lug on an axially adjacent diffuser to form an interlocked stack that prevents relative rotation between the diffusers;

a sealing member located on an exterior of each diffuser, an inner surface formed on each diffuser that forms a seal with a sealing member on respective axially adjacent diffusers; and the diffusers are free of contact with and unsealed to the tubular housing.

9. A pump assembly according to claim 8, wherein:

the diffusers are mechanically locked to the tubular housing with a retaining ring mounted in a recess formed in the tubular housing;

a retaining tube extends from the retaining ring and is coupled to the diffusers; and the retaining ring and the retaining tube are located above the diffusers.

10. A pump assembly according to claim 8, wherein the at least one lug comprises a plurality of symmetrically arrayed castellations that engage and nest in an equal number of complementary recesses on respective axially adjacent diffusers.

11. A pump assembly according to claim 8, wherein the sealing members comprise o-rings, and further comprising a housing adapter mounted and sealed to one of the diffusers, the housing adapter having a housing seal member that seals with the tubular housing, such that the housing adapter vertically supports the diffusers in the tubular housing.

12. A pump assembly according to claim 8, wherein a radial clearance of 0.003 to 0.005 inches separates an outer diameters of the diffusers and an inner diameter of the tubular housing.

13. An electrical submersible pump assembly, comprising:

a motor coupled to a seal section, which in turn is coupled to a pump, wherein the pump comprises:

a housing having an axis and a recess;

a plurality of diffusers coaxially mounted in the housing to prevent relative rotation therebetween, each diffuser comprising a cylindrical body having at least one lug extending therefrom in an axial direction, a complementary recess formed in the cylindrical body extending in the axial direction opposite the lug, the complementary recess receiving and nesting a respective lug on an axially adjacent diffuser to form an interlocked stack that prevents relative rotation between the diffusers;

a sealing member located on an exterior of each diffuser, and an inner surface formed on each diffuser that forms a seal with a sealing member on respective axially adjacent diffusers;

a retaining ring mounted in the recess in the housing for mechanically locking the diffusers to the housing to prevent rotation therebetween; and a retaining tube extending from the retaining ring and coupled to the diffusers; and a housing adapter mounted and sealed to one of the diffusers, the housing adapter having a housing seal member that seals with the housing, such that the housing adapter vertically supports the diffusers in the housing.

14. A pump assembly according to claim 13, wherein the at least one lug comprises a plurality of symmetrically arrayed castellations that engage and nest in an equal number of complementary recesses on respective axially adjacent diffusers.

* * * * *